US007125295B2

(12) United States Patent
Zhao et al.

(10) Patent No.: US 7,125,295 B2
(45) Date of Patent: Oct. 24, 2006

(54) INTERLOCKING RING TERMINALS

(75) Inventors: Weiping Zhao, Canton, MI (US); George Farquhar, Batavia, OH (US); Gordon Noethen, Cologne (DE)

(73) Assignee: Alcon Fujikura Limited, Franklin, TN (US)

( * ) Notice: Subject to any disclaimer, the term of this patent is extended or adjusted under 35 U.S.C. 154(b) by 0 days.

(21) Appl. No.: 10/960,242

(22) Filed: Oct. 7, 2004

(65) Prior Publication Data

US 2006/0079138 A1 Apr. 13, 2006

(51) Int. Cl.
*H01R 11/11* (2006.01)

(52) U.S. Cl. ..... 439/883; 439/287; 439/907

(58) Field of Classification Search ..... 439/883, 439/287, 907; 174/84 C
See application file for complete search history.

(56) References Cited

U.S. PATENT DOCUMENTS 4,371,230 A * 2/1983 Inoue ..... 439/849
5,188,544 A * 2/1993 Mukai ..... 439/777
5,577,927 A * 11/1996 Okada et al. ..... 439/287
5,865,637 A * 2/1999 Shinozaki et al. ..... 439/287
6,019,614 A * 2/2000 Baur et al. ..... 439/92
6,172,586 B1 * 1/2001 Ferree et al. ..... 335/202
6,476,325 B1 * 11/2002 Kondo ..... 174/84 C
6,786,751 B1 * 9/2004 Maeda et al. ..... 439/287

* cited by examiner

*Primary Examiner*—Michael C. Zarroli
(74) *Attorney, Agent, or Firm*—Greenberg Traurig LLP; Harry A. Hild, Jr.

(57) ABSTRACT

The present invention provides a terminal ring assembly structured for engagement to a conductor post. The terminal ring assembly of the present invention includes a first ring element and a second ring element, each having a circular body and at least one grip having crimpable barrels for engaging a wire in electrical connectivity. The first and second ring elements further include an interlocking device, in which the interlocking components of the first and second ring elements engage each other so that the first and second ring elements are locked together.

23 Claims, 3 Drawing Sheets

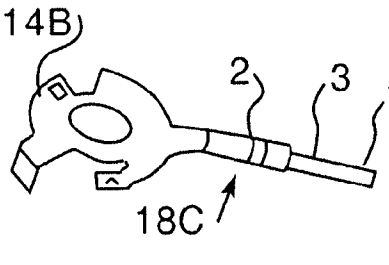
FIG. 4A
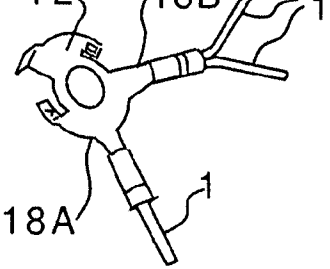
FIG. 4C
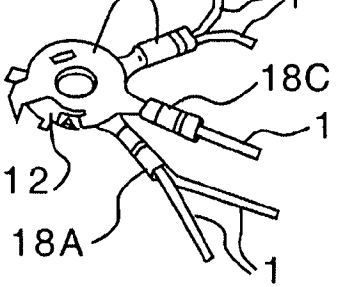
FIG. 4E
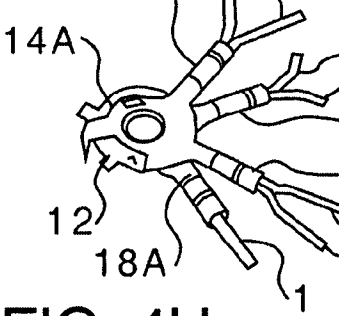
FIG. 4H
FIG. 4B
FIG. 4D
FIG. 4F
FIG. 4G

INTERLOCKING RING TERMINALS

FIELD OF THE INVENTION

The present invention relates to an electric terminal, and, more specifically, to a ring terminal assembly formed from two ring elements and having multiple wire couplings.

DESCRIPTION OF THE RELATED ART

Ring terminals are typically used to couple a wire to a conductor. The ring terminal is made from an electrically conductive material and includes a flat ring-shaped body having a radial arm or "grip." The grip is folded, or crimped, around the exposed end of an insulated electrical wire. The ring-shaped body is then disposed about a conductor post, such as a stud or a bolt. That is, the stud or bolt is passed through the ring-shaped body and the ring terminal is secured with a fastener. The stud or bolt is in electrical communication with an electrical system or circuit. Thus, following the installation of the ring terminal, the wire is also coupled to the electrical system or circuit. Such ring terminals are typically plated with a material such as, but not limited to, tin. The plating helps to resist corrosion.

Generally, the grip includes a "barrel," structured to be crimped about one, or two, wires. That is, the grip includes a generally flat member having two generally perpendicular connector tabs extending from opposite sides of the member. The tabs are initially, generally flat so that the entire tab is almost perpendicular to the member, thereby forming a U-shape or a V-shape. Hereinafter, the U-shaped or V-shaped tabs shall be referred to as an "open barrel." The exposed tip of an insulated wire is placed in the open barrel and the tabs are bent, or crimped, to engage the exposed wire tip, hereinafter a "closed barrel." The grip is typically an outer pair of support tabs which are substantially similar to the connector tabs. The support tabs are structured to be crimped over the portion of the wire having an insulator.

While ring terminals are simple and inexpensive, they have several disadvantages. For example, a single grip can be crimped with one or two wires while maintaining an acceptable pull force. If three or more wires are crimped into a single grip, the wire(s) may be easily pulled out of the grip, creating an un-reliable connection between wire and ring terminal. Also, if more than three wires need to be coupled to a single location, multiple ring terminals must be used. As noted above, terminals are plated, usually with tin, to resist corrosion. If more than two plated terminals are stacked together, the plating on the terminals may be subject to cold-softening. Even with the cold-softening, the connection between the bolt and nut joint remains acceptably reliable, or tight, with two plated terminals. However, if more than three plated terminals are stacked, the bolt-nut joint may become loose and cause a thermal event and electrical failure due to accumulated cold-softening. In other words, a single stud is limited to a maximum of 4 wires as each plated terminals can be crimped to two wires.

If more than four wires are needed to connect at a single stud point, three or more un-plated terminals could be stacked on the stud to avoid the accumulated cold-softening effect. However, the terminal then did not have corrosion protection. So, such a solution is limited to use in a non-corrosive area. This solution also has the disadvantage of costing more due to the use of additional terminals.

There is, therefore, a need for a ring terminal assembly that is structured to accept a variable number of wires.

There is a further need for a two-part terminal ring that may be interlocked and that is plated and structured to accept multiple wires.

There is a further need for a terminal ring structured to accept multiple wires and which functions with existing crimping hardware.

SUMMARY OF THE INVENTION

These needs, and others, are met by the present invention which provides a ring terminal assembly having two interlocking ring elements. Each ring element has at least one grip supporting a multi-wire barrel. The multi-wire barrel typically accepts one or two wires. Each ring element may have one or two grips. The ring elements are structured to interlock to each other to ensure contact between the ring elements. Preferably, the interlock device is a tab with a projection disposed on one ring element and a tab with an opening disposed on the other ring element. The two tabs are structured to engage each other so that the projection is disposed within the opening. By using either, or both, of the ring elements, the ring terminal assembly may be adapted to couple between one and eight wires to a stud without an empty grip.

Preferably, each ring element includes a generally flat ring-like body, and the tabs are slightly offset, but generally parallel to, the ring-like bodies. The ring bodies are placed against each other and rotated so that the tabs move towards each other until the projection engages the opening. One ring element may include a collar about the central opening to assist in aligning the ring-like bodies.

BRIEF DESCRIPTION OF THE DRAWINGS

A full understanding of the invention can be gained from the following description of the preferred embodiments when read in conjunction with the accompanying drawings in which:

FIG. 4A is an isometric view of a one-wire terminal ring assembly. FIG. 4B is an isometric view of a two-wire terminal ring assembly. FIG. 4C is an isometric view of a three-wire terminal ring assembly. FIG. 4D is an isometric view of a four-wire terminal ring assembly. FIG. 4E is an isometric view of a five-wire terminal ring assembly. FIG. 4F is an isometric view of a six-wire terminal ring assembly. FIG. 4G is an isometric view of a seven-wire terminal ring assembly. FIG. 4H is an isometric view of an eight-wire terminal ring assembly.

DETAILED DESCRIPTION OF PREFERRED EMBODIMENTS

As used herein, directional terms, such as "upper" and "lower" relate to the terminal ring assembly as shown in the Figures and are not limiting upon the claims.

Figure 1B:
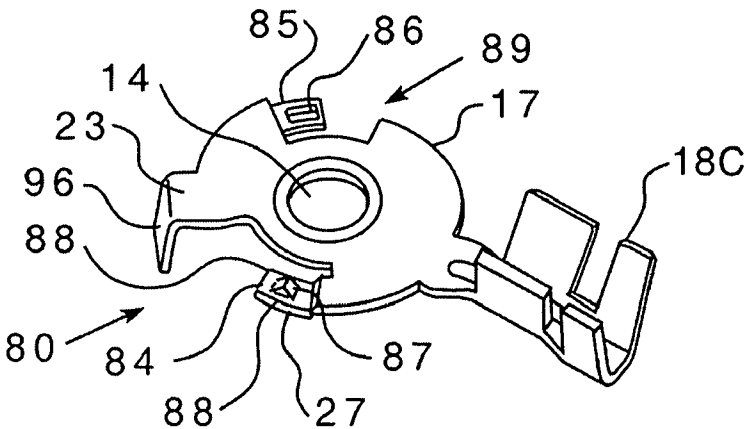
FIG. 1B is an isometric view of an exploded terminal ring with one grip prior to engaging any wires.
Figure 1A:
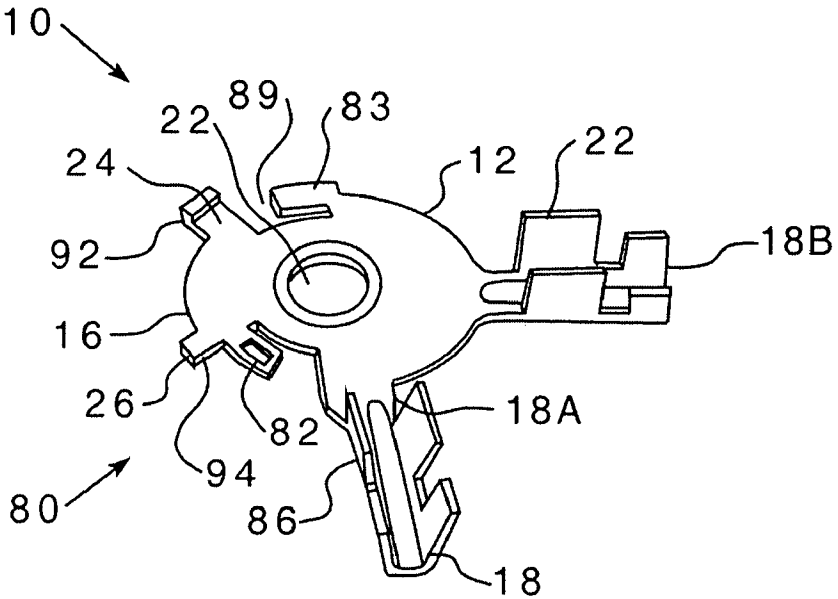
FIG. 1A is an isometric view of an exploded terminal ring with two grips prior to engaging any wires.
Figure 2B:
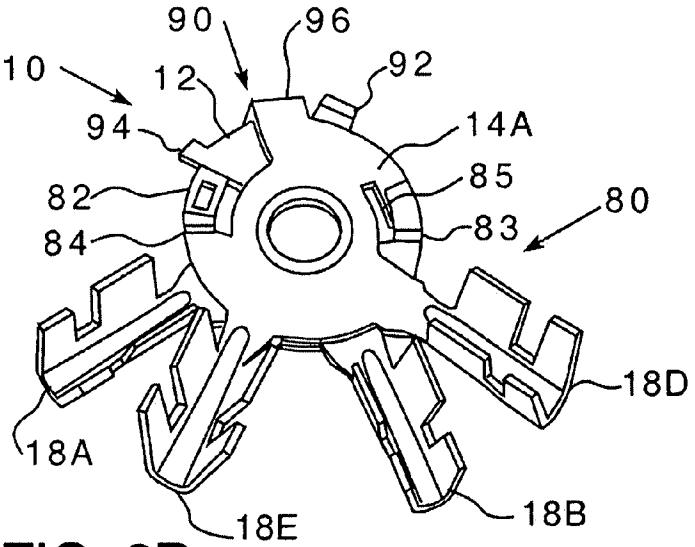
FIG. 2B is an isometric view of a terminal ring assembly wherein each ring element has two grips and wherein the ring elements are locked together.
Figure 2A:
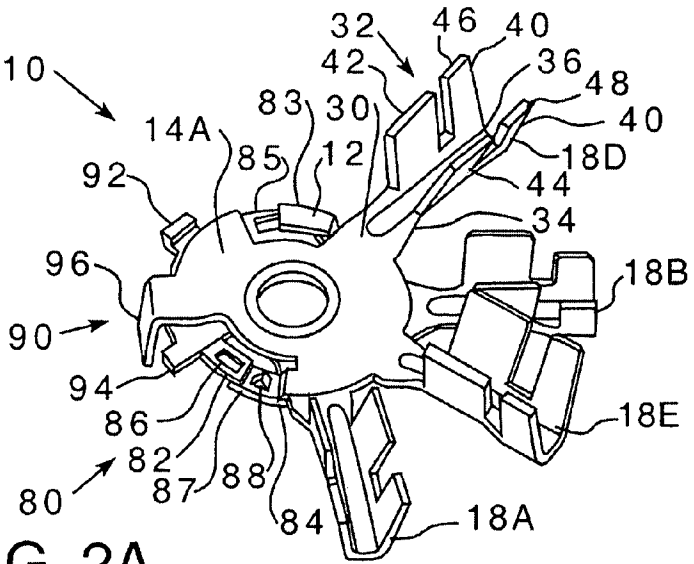
FIG. 2A is an isometric view of a terminal ring assembly wherein each ring element has two grips and wherein the ring elements are not locked together.

As shown in FIGS. 1A and 1B, a terminal ring assembly 10 includes a lower, first ring element 12 (FIG. 1A) and an upper, second ring element 14 (FIG. 1B). Both the first and second ring elements 12, 14 are, preferably, stamped from a flat sheet of conductive metal and shaped as follows. The terminal ring assembly first and second ring elements 12, 14 may be plated with a corrosion resistant material, such as tin. The first ring element 12 includes a generally circular, ring-like body 16, that is, a torus, and at least one radial arm, hereinafter a "grip" 18, described more fully below. Preferably, and as discussed hereinafter, the first ring element 12 includes two grips 18A, 18B. The first ring element body 16 includes a central opening 22, a collar 24, having an outer diameter, disposed about the central opening 22, and a first component 26 of an interlock device 80, described below. The first ring element body 16 is generally flat. The second ring element 14 also includes a generally circular, ring-like body 17, that is, a torus, and at least one radial arm, hereinafter a "grip" 18, described more fully below. Preferably, and as discussed hereinafter, the second ring element 14 includes either one grip 18C (FIG. 1B) or two grips 18D, 18E (FIG. 2A). The second ring element body 17 includes a central opening 23, and a second component 27 of an interlock device 80, described below. The second ring element opening 23 has about the same diameter as the collar 24 outer diameter. Thus, the second ring element opening 23 is structured to engage, or abut, the collar 24. The second ring element body 17 is also generally flat.

The interlock device 80 includes the first and second components 26, 27 noted above, one component on each ring element 12, 14. In the preferred embodiment, the first and second components 26, 27 are each flexible, arcuate tabs 82, 84 (respectively) stamped from the first and second ring element bodies 16, 17 having either an opening 86 or a projection 87, such as a wedge 88. The arcuate tabs 82, 84 are offset, but substantially parallel to, the plane of the first and second ring element bodies 16, 17. Adjacent to each arcuate tab 82, 84 is a gap 89. As shown in FIG. 1, the first arcuate tab 82 on the first ring element 12 is offset upwardly and the second arcuate tab 84 on the second ring element 14 is offset downwardly. The amount of the offset is about the thickness of the first and second ring element bodies 16, 17. Thus, when the first and second ring elements 12, 14 are coupled, the first arcuate tab 82 on the first ring element 12 is, generally, in the plane of the second ring element body 17 and the second arcuate tab 84 on the second ring element 14 is, generally, in the plane of the first ring element body 16. In this configuration, when the first and second ring elements 12, 14 are engaged, that is, coupled, and rotated, the first arcuate tab 82 will move over the second arcuate tab 84. Thus, where the first arcuate tab 82 has an opening 86, and the second arcuate tab 84 has a wedge 88, the wedge 88 will engage the opening 86, thereby interlocking the ring elements 12, 14. In a preferred embodiment, each ring element 12, 14 includes two arcuate tabs. That is, the first ring element 12 includes two arcuate tabs 82, 83 and the second ring element includes two arcuate tabs 84, 85. Where each ring element 12, 14 includes two arcuate tabs, one tab will have an opening 86 and the other tab will have a wedge 88. The openings 86 and wedges 88 on opposing ring elements 12, 14 are structured to engage each other. That is, the first ring element 12 interlock device 80 includes a first flexible tab 82 having an opening 86 and a second flexible tab 83 having a projection 87, and the second ring element 14 includes a third flexible tab 84 having a projection 87 and a fourth flexible tab 85 having an opening 86.

The interlock device 80 may also include a stop device 90 structured to limit the rotation of the ring elements 12, 14 relative to each other. The stop device 90, preferably, includes a pair of radial stops 92, 94 extending from the first ring element 12 and a perpendicular tab 96 extending from the perimeter of the second ring element 14. When the ring elements 12, 14 are coupled, the perpendicular tab 96 is disposed between the radial stops 92, 94. When the ring elements 12, 14 are rotated relative to each other, the perpendicular tab 96 will contact either radial stop 92, 94, thereby limiting the rotation of the ring elements 12, 14 relative to each other. Further, tab 96 may be dropped into a slot of sheet metal and serve as anti-rotation during tightening a nut (not shown) to a stud.

Each grip 18 is substantially similar. As such, a grip 18 will be described below and detailed on FIG. 2A. It is understood that each separate grip 18 includes like components. Each grip 18 includes an arm 30 and a crimpable barrel 32. The arm 30 is a flat member 34 extending radially from the associated ring-like body 16, 17. The barrel 32 includes a flat member 36, that is an extension of the arm flat member 34, and at least one pair 40 of generally perpendicular tabs extending laterally from the barrel flat member 36. Preferably, there are two sets of tabs, an inner pair of tabs 42, 44 and an outer pair of tabs 46, 48. The pairs of tabs 42, 44, 46, 48 are bent upwardly, as shown in the figures, to form a U-shape or a V-shape. In this configuration, the tabs 42, 44, 46, 48 constitute an "open" barrel 32 as is known in the art. The use of four tabs 42, 44, 46, 48 are structured to cooperate with standard crimping tools so that the inner pair of tabs 42, 44 and the outer pair of tabs 46, 48 are coupled to one or two wires 1 (FIG. 4A–4H). That is, the barrel flat member 36 has a width sufficient to accommodate two wires placed thereon. As shown in FIGS. 4A–4H, the tabs 42, 44, 46, 48 are structured to be crimped about the wire(s) 1, with the inner pair of tabs 42, 44 contacting an exposed tip(s) 2 of the wire(s) 1, and the outer pair of tabs 46, 48 contacting the wire insulation 3. In this configuration the barrel 32 is "closed."

Figure 3B:
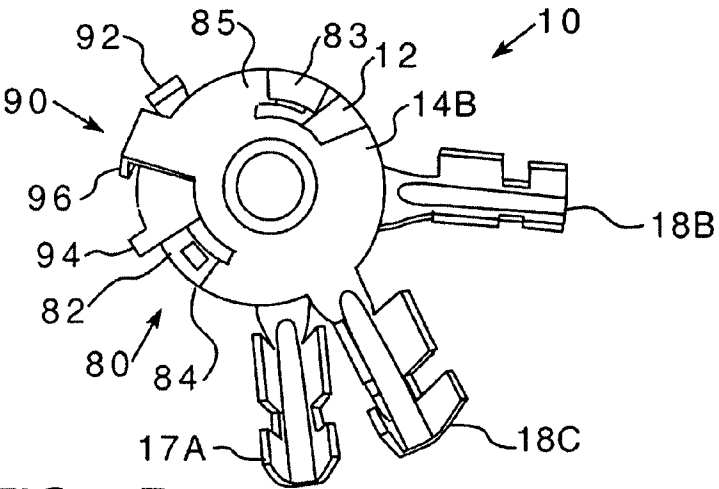
FIG. 3B is an isometric view of a terminal ring assembly wherein one ring element has two grips and the other ring element has a single grip, and wherein the ring elements are locked together.
Figure 3A:
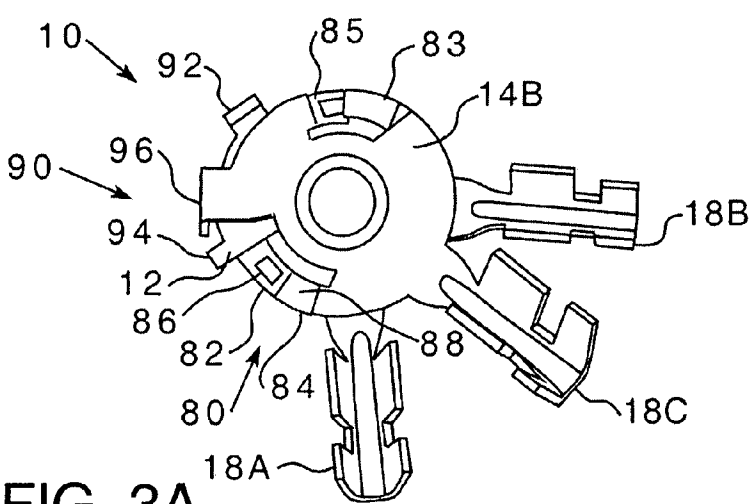
FIG. 3A is an isometric view of a terminal ring assembly wherein one ring element has two grips and the other ring element has a single grip, and wherein the ring elements are not locked together.

As noted above, and as shown in FIG. 1A, the first ring element 12 preferably includes two grips 18, a first grip 18A, and a second grip 18B. The first and second grips 18A, 18B are disposed about 90 degrees apart on the first ring element body 16. As shown in FIG. 3A, the second ring element 14A, 14B includes either one grip 18, a third grip 18C (FIG. 1B), or, as shown in FIG. 2A, two grips 18, an alternate third grip 18D and a fourth grip 18E. Hereinafter, a second ring element with two grips shall be identified by the reference number "14A" and a second ring element with one grip shall be identified by the reference number "14B"

Thus, as shown in FIG. 2A, a terminal ring assembly 10 having four grips 18A, 18B, 18D, 18E is assembled as follows. A first ring element 12 having two grips 18A, 18B is provided and a second ring element 14A having two grips 18D, 18E is also provided. The ring elements 12, 14A are coupled in an unlocked position with the first and second ring element bodies 16, 17 disposed adjacent to each other with the collar 24 extending through the second ring element opening 23. Additionally, each arcuate tab 82, 83, 84, 85 is disposed in a gap 89 on the opposing ring element 12, 14A and the perpendicular tab 96 is disposed between the two stops 92, 94. As shown in FIG. 2B, the first and second elements are then rotated relative to each other until the arcuate tabs 82, 83, 84, 85 overlay each other so that each wedge 88 engages an opening 86. Rotation of the first and second ring elements relative to each other is halted by the perpendicular tab 96 contacting a stop 92.

As shown in FIG. 3A a terminal ring assembly 10 having three grips 18A, 18B, 18C is assembled as follows. A first ring element 12 having two grips 18C is provided and a second ring element 14B having two grips 18C is also provided. The ring elements 12, 14B are coupled in an unlocked position with the first and second ring element bodies 16, 17 disposed adjacent to each other with the collar 24 extending through the second ring element opening 23. Additionally, each arcuate tab 82, 83, 84, 85 is disposed in a gap 89 on the opposing ring element 12, 14B and the perpendicular tab 96 is disposed between the two stops 92, 94. As shown in FIG. 3B, the first and second ring elements 12, 14B are then rotated relative to each other until the arcuate tabs 82, 83, 84, 85 overlay each other so that each wedge 88 engages an opening 86. Rotation of the first and second ring elements 12, 14B relative to each other is halted by the perpendicular tab 96 contacting a stop 92.

Given these ring elements 12, 14A, 14B, the terminal ring assembly 10 may be adapted to couple between one and eight wires 1 to a stud (not shown). That is, as shown in FIGS. 4A and 4B, a single second ring element 14B having one grip 18C may be coupled to one wire 1 (FIG. 4A) or two wires 1 (FIG. 4B). As shown in FIG. 4C, a single first ring element with two grips 18A, 18B may be coupled to three wires 1; one wire coupled to one grip 18A and two wires 1 coupled to the other grip 18B. Alternatively, as shown in FIG. 4D, a single first ring element with two grips 18A, 18B may also be coupled to four wires 1; two wires 1 coupled to one grip 18A and two wires 1 coupled to the other grip 18B. As shown in FIG. 4E, a terminal ring assembly 10 having a single first ring element with two grips 18A, 18B and a second ring element 14B having one grip 18C may be used to couple five wires 1 to a stud. That is, on the first ring element 12, two wires 1 are coupled to one grip 18A and two wires 1 are coupled to the other grip 18B and, on the second ring element 14B, one wire 1 is coupled to the grip 18C. As shown in FIG. F, this same configuration of a first ring element 12 and a single grip second ring elements 14B may be used to couple six wires 1 to a stud. That is, on the first ring element 12, two wires 1 are coupled to one grip 18A and two wires 1 are coupled to the other grip 18B and, on the second ring element 14B, two wires 1 coupled to the grip 18C. As shown in FIG. 4G, a terminal ring assembly 10 having a single first ring element 12 with two grips 18A, 18B and a second ring element 14A having two grips 18D, 18E may be used to couple seven wires 1 to a stud. That is, on the first ring element, one wire 1 is coupled to one grip 18A and two wires 1 are coupled to the other grip 18B and, on the second ring element 14A, two wires 1 are coupled to each grip 18D, 18E. This same configuration of a first ring element 12 and a single grip second ring elements 14A may be used to couple eight wires 1 to a stud. That is, on the first ring element 12, two wires 1 are coupled to each grip 18A, 18B and, on the second ring element 14A, two wires 1 coupled to each grip 18D, 18E. Of course, the location of the single and double wires 1 on a particular grip 18A–18E may vary as needed.

While specific embodiments of the invention have been described in detail, it will be appreciated by those skilled in the art that various modifications and alternatives to those details could be developed in light of the overall teachings of the disclosure. For example, the stop device 90 could also be a perpendicular tab 96 on one ring element disposed in a slot on the other ring element. Accordingly, the particular arrangements disclosed are meant to be illustrative only and not limiting as to the scope of invention which is to be given the full breadth of the claims appended and any and all equivalents thereof.

What is claimed is:

1. A terminal ring assembly structured to engage a conductor post, said terminal ring assembly comprising:

a first ring clement having a generally first circular body with a first central opening, at least two grips, each said grip having a crimpable barrel structured to engage at least one wire, and an interlock device first component;

a second ring element having a generally second circular body with a central opening, at least one grip having a crimpable barrel structured to engage at least one wire, and an interlock device second component;

wherein said interlock device first and second components are structured to engage each other so that said first ring element and said second ring element are locked together and said first and second ring elements are plated with a corrosion resistant material.

2. The terminal ring assembly of claim 1, wherein each said crimpable barrel is structured to engage up to two wires.

3. The terminal ring assembly of claim 1, wherein said second ring element includes two grips, each said grip having a crimpable barrel disposed thereon.

4. The terminal ring assembly of claim 1, wherein:

said first ring element includes a first and second grip, said first and second grips each having a crimpable barrel disposed thereon; and said second ring element includes a third and fourth grip, said third and fourth grips each having a crimpable barrel disposed thereon.

5. The terminal ring assembly of claim 4, wherein each said crimpable barrel is structured to engage two wires.

6. The terminal ring assembly of claim 1, wherein said second ring clement includes one grip having a crimpable barrel disposed thereon.

7. The terminal ring assembly of claim 1, wherein:

said first ring element includes a first and second grip, said first arid second grips each having a crimpable barrel disposed thereon; and said second ring clement includes a third grip having a crimpable barrel disposed thereon.

8. The terminal ring assembly of claim 7, wherein each said crimpable barrel is structured to engage two wires.

9. The terminal ring assembly of claim 1, wherein:

said first interlock device includes at least one flexible arcuate tab having a projection;

said second interlock device includes at least one flexible arcuate tab having an opening; and wherein said projection is structured to engage said opening.

10. The terminal ring assembly of claim 9, wherein each said projection is a wedge.

11. The terminal ring assembly of claim 9, wherein:

said first ring element body includes a collar disposed about said central opening, said collar having an outer diameter;

said second ring element central opening having a diameter about the same as said collar diameter; and wherein said first and second elements are structured to engage each other with said second ring element body abutting said first ring element collar.

12. The terminal ring assembly of claim 11, wherein:

said first ring element at least one tab is arcuate having generally the same center as said circular body; and said second ring element at least one tab is arcuate having generally the same center as said circular body.

13. The terminal ring assembly of claim 1, wherein:

said first ring element interlock device includes a first flexible tab having an opening and a second flexible tab having a projection;

said second ring element includes a third flexible tab having a projection and a fourth flexible tab having an opening; and wherein said first flexible tab opening is structured to engage said third flexible tab projection and said fourth flexible tab opening is structured to engage said second flexible tab projection.

14. The terminal ring assembly of claim 13, wherein each said projection is a wedge.

15. The terminal ring assembly of claim 13, wherein:

said first ring element body includes a collar disposed about said central opening, said collar having a diameter;

said second ring element central opening having a diameter about the same as said collar diameter; and wherein said first and second elements arc structured to engage each other with said second ring element body abutting said first ring clement collar.

16. The terminal ring assembly of claim 13, wherein:

said first ring element at least one tab is arcuate having generally the same center as said circular body; and said second ring element at least one tab is arcuate having generally the same center as said circular body.

17. The terminal ring assembly of claim 16, wherein each said crimpable barrel is structured to engage two wires.

18. The terminal ring assembly of claim 16, wherein said second ring clement includes two grips, each said grip having a crimpable barrel disposed thereon.

19. The terminal ring assembly of claim 16, wherein:

said first ring element includes a first and second grip, said first and second grips each having a crimpable barrel disposed thereon; and said second ring element includes a third and fourth grip, said third and fourth grips each having a crimpable barrel disposed thereon.

20. The terminal ring assembly of claim 16, wherein said second ring element includes a grip having two crimpable barrels disposed thereon.

21. The terminal ring assembly of claim 16, wherein:

said first ring element includes a first and second grip, said first and second grips each having a crimpable barrel disposed thereon; and said second ring element includes a grip having a crimpable barrel disposed thereon.

22. A terminal ring assembly structured to engage a conductor post, said terminal ring assembly comprising:

a first ring element having a generally first circular body with a first central opening, at least two grips, each said grip having a crimpable barrel structured to engage at least one wire, and an interlock device first component;

a second ring element having a generally second circular body with a central opening, at least one grip having a crimpable barrel structured to engage at least one wire, and an interlock device second component;

wherein said interlock device first and second components are structured to engage each other so that said first ring element and said second ring element are locked together wherein said interlock device first component comprises at least one first arcuate tab having generally a same center as said first circular body and having a first slot positioned in said first circular body between said at least one first arcuate tab and said first central opening and said interlock device second component comprises at least one second arcuate tab having generally the seine center as said second circular body and having a second slot in said second circular body between said at least one second arcuate tab and said second central opening.

23. The terminal ring assembly of claim 22, wherein said first and second ring elements are plated with a corrosion resistant material.

* * * * *

UNITED STATES PATENT AND TRADEMARK OFFICE

CERTIFICATE OF CORRECTION

PATENT NO. : 7,125,295 B2
APPLICATION NO. : 10/960242
DATED : October 24, 2006
INVENTOR(S) : Zhao et al.

It is certified that error appears in the above-identified patent and that said Letters Patent is hereby corrected as shown below:

On page 1, section (73) Assignee: delete “Alcon” and insert -- Alcoa --.

On page 7, column 6, line 43, after “first” delete “arid” and insert -- and --.

On page 8, column 8, line 33, after “the” delete “seine” and insert -- same --.

Signed and Sealed this

Twentieth Day of November, 2007

JON W. DUDAS
*Director of the United States Patent and Trademark Office*